US009533347B2

(12) United States Patent
Song et al.

(10) Patent No.: US 9,533,347 B2
(45) Date of Patent: Jan. 3, 2017

(54) CASTING ROLL FOR TWIN-ROLL STRIP CASTER

(71) Applicant: POSCO, Pohang-si, Gyeongsangbuk-do (KR)

(72) Inventors: Byoung-Jun Song, Pohang-si (KR); Sung-Jin Park, Pohang-si (KR); Yoon-Ha Kim, Pohang-si (KR); Dae-Sung Lee, Pohang-si (KR); Seong-In Jeong, Pohang-si (KR)

(73) Assignee: POSCO, Pohang-si (KR)

( * ) Notice: Subject to any disclaimer, the term of this patent is extended or adjusted under 35 U.S.C. 154(b) by 28 days.

(21) Appl. No.: 14/539,462

(22) Filed: Nov. 12, 2014

(65) Prior Publication Data

US 2015/0129156 A1 May 14, 2015

(30) Foreign Application Priority Data

Nov. 14, 2013 (KR) ..... 10-2013-0138181
Jul. 24, 2014 (KR) ..... 10-2014-0093996

(51) Int. Cl.
*B22D 11/06* (2006.01)

(52) U.S. Cl.
CPC ..... *B22D 11/0622* (2013.01); *B22D 11/0651* (2013.01)

(58) Field of Classification Search
CPC .. B22D 11/06; B22D 11/0622; B22D 11/0651
USPC ..... 164/427, 428
See application file for complete search history.

(56) References Cited

U.S. PATENT DOCUMENTS 5,010,947 A * 4/1991 Yukumoto et al. ..... B22D 11/0651 164/428
5,179,996 A * 1/1993 Blin et al. ..... B22D 11/0651 164/428
5,701,948 A 12/1997 Strezov et al.
6,059,014 A * 5/2000 Strezov ..... B22D 11/0611 164/472
6,431,256 B1 * 8/2002 Ferretti et al. ..... B22D 11/0651 164/428
8,122,937 B2 * 2/2012 Eastman ..... B22D 11/0651 164/428
2010/0000968 A1 1/2010 Choi et al.

FOREIGN PATENT DOCUMENTS

KR 10-0415905 B1 4/2004
KR 10-0779574 11/2007
KR 10-0779600 11/2007
KR 10-2012-0016369 2/2012
KR 10-1372692 3/2014
KR 10-1372741 3/2014
KR 20140080037 A 6/2014

* cited by examiner

*Primary Examiner* — Kevin P Kerns
(74) *Attorney, Agent, or Firm* — The Webb Law Firm

(57) ABSTRACT

There are provided a casting roll of a twin-roll strip caster and a method for manufacturing a high-nitrogen duplex stainless steel strip having no dimple. The casting roll has an average roughness Ra of 10 μm to 30 μm, and diagonal fine grooves having a width of 50 μm to 500 μm, an interval of 100 μm to 1000 μm, and a depth of 50 μm to 200 μm are formed in the casting roll. The diagonal fine grooves are symmetrically intersecting each other at an angle of 30° to 70° with respect to circumferential direction of the casting roll.

9 Claims, 11 Drawing Sheets

CASTING ROLL FOR TWIN-ROLL STRIP CASTER

CROSS-REFERENCE TO RELATED APPLICATIONS

This application claims the benefit of Korean Patent Application No. 10-2013-0138181 filed on Nov. 14, 2013, and 10-2014-0093996 filed on Jul. 24, 2014, with the Korean Intellectual Property Office, the disclosures of which are incorporated herein by reference.

BACKGROUND

The present disclosure relates to a casting roll for a twin-roll strip caster for manufacturing a strip directly from molten metal, and more particularly, to a casting roll for a twin-roll strip caster for preventing surface defects in a strip.

In general, according to a strip casting method using a twin-roll strip caster, a thin strip having a thickness of about 2 mm to about 6 mm can be formed by directly casting molten steel between two rotating rolls from a tundish, through a nozzle. Therefore, manufacturing costs may be decreased owing to reduced manufacturing processes, and product quality may be improved owing to rapid cooling. Thus, the strip casting method has been intensively researched as a steel forming process method.

FIG. 1 is a schematic view illustrating a twin-roll strip caster. Referring to FIG. 1, molten steel is supplied to a sump 4 from a ladle 1 through a tundish 2 and a submerged nozzle 3. The molten steel supplied to the sump 4 is formed into a strip while passing between twin casting rolls 5.

If the molten steel contained in a region of the sump 4, surrounded by the twin casting rolls 5 and edge dams 6 is exposed to the air, the molten steel may be oxidized, and resulting oxides may have a significant effect on product quality. Therefore, a meniscus shield 7 is disposed above the sump 4 to cover the surface of the molten steel with a gas atmosphere.

Thus, a space surrounded by the surface of the molten steel, the twin casting rolls 5, and the edge dams 6 is defined in an upper region of the sump 4, and gas may be supplied to the upper region of the sump 4 to form a gas atmosphere preventing oxidation of the molten steel.

The molten steel supplied to the interior of the sump 4 is solidified as shells while being cooled on the surfaces of the twin casting rolls 5, and the solidified shells are attached together as a strip at the nip of the twin casting rolls 5. In this case, since the molten steel is formed into solidified shells while quickly making contact with the twin casting rolls 5 and is then formed into a strip while leaving the twin casting rolls 5, the surface of the strip is subjected to sudden thermal stress during solidification.

Therefore, if the surfaces of the twin casting rolls 5 are flat, the solidified shells may be locally separated from the surfaces of the twin casting rolls 5 by the gas atmosphere (a separation phenomenon) and thus may be unevenly solidified due to non-uniform heat transfer. This may cause the formation of cracks in the solidified shells.

In the related art, a twin-roll strip caster in which dimples are formed in the surfaces of casting rolls is used for general steels to prevent the separation phenomenon of solidified shells. In addition, since the separation phenomenon of solidified shells occurs severely in the case of steels containing large amounts of nitrogen and manganese or steels undergoing a high degree of phase transformation during solidification, casting rolls of a twin-roll strip caster are shot-blasted to form dimples thereon (a shot blasting method), and fine grooves are formed in a parallel strip pattern in the circumferential direction of the casting rolls to discharge gas therethrough as illustrated in FIG. 2A.

However, if fine grooves are formed in the surfaces of casting rolls as illustrated in FIG. 2A, the shape of the fine grooves is transferred to a strip, and thus a striped pattern is present on the surface of the strip after a casting process, as illustrated in FIG. 2B. In addition, if the strip is cold-rolled and then subjected to a formation process (drawing process), the surface of the strip (product) may be heavily dimpled as illustrated in FIG. 3A. As illustrated in FIG. 3B, dimples are periodically formed in the surface of the strip after casting. Such dimples have a negative effect on the appearance of the strip and incur additional costs because an additional process such as a polishing process is necessary to remove the dimples.

As described above, if fine grooves are formed across the entire widths of casting rolls, during casting, locally excessively solidified shells (hereinafter referred to as skulls) may be mixed and pass through the nip of the casting rolls, and at this time, the solidified shells may be over-pressed and caught in the fine grooves. That is, the solidified shells may stick to the casting rolls (a sticking phenomenon).

As illustrated in FIGS. 6A and 6B, widthwise edge portions may be separated from the strip due to the sticking phenomenon, and the separated edge portions may stick to the casting rolls and rotate together therewith. Then, the separated edge portions may be remixed with molten steel, and thus more edge portions may be separated from the strip. As a result, a casting process may be suspended due to the introduction of separated portions.

SUMMARY

An aspect of the present disclosure may provide a casting roll for a twin-roll strip caster for manufacturing a strip without surface dimples by using high-nitrogen duplex stainless steel, high-manganese steel, or steel undergoing a high degree of phase transformation during solidification.

An aspect of the present disclosure may also provide a casting roll for a twin-roll strip caster, the casting roll including a plurality of diagonal fine grooves formed in a surface thereof, the fine grooves symmetrically intersecting each other at an angle of 30° to 70° with respect to a circumferential direction of the casting roll.

The fine grooves may have a reverse triangular cross-sectional shape in widthwise edge portions of the casting roll.

According to an aspect of the present disclosure, a casting roll for a twin-roll strip caster may have an average roughness Ra of 10 μm to 30 μm and include diagonal fine grooves having a width of 50 μm to 500 μm, an interval of 100 μm to 1000 μm, and a depth of 50 μm to 200 μm, the diagonal fine grooves symmetrically intersecting each other at an angle of 30° to 70° with respect to circumferential direction of the casting roll.

According to another aspect of the present disclosure, a casting roll for a twin-roll strip caster may include a plurality of fine grooves formed in a surface thereof, and the fine grooves may have a reverse triangular cross-sectional shape in widthwise edge portions of the casting roll.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
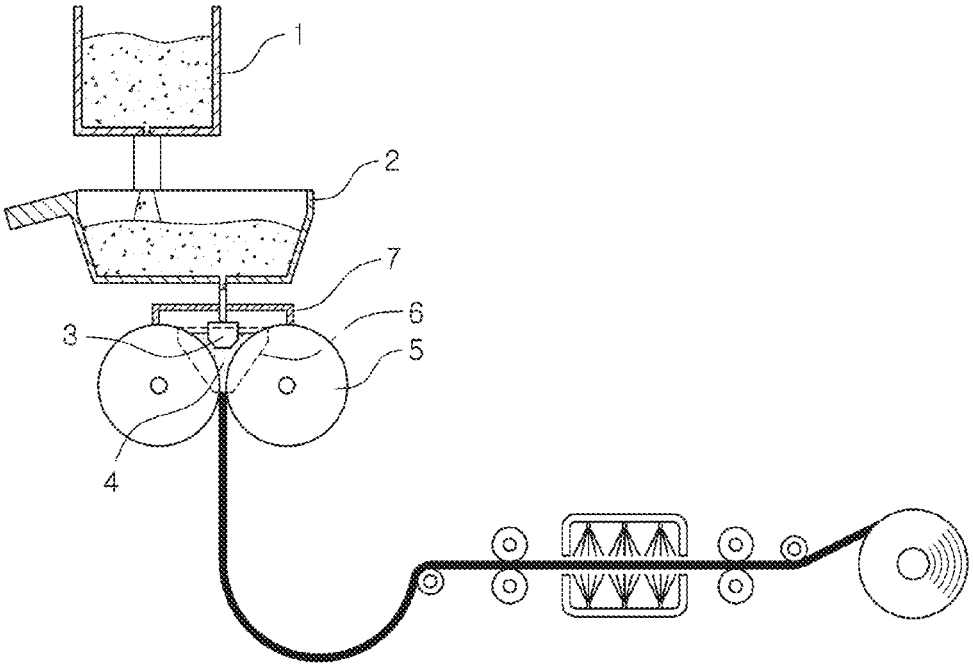
FIG. 1 is a schematic view illustrating a twin-roll strip caster.
Figure 2A:
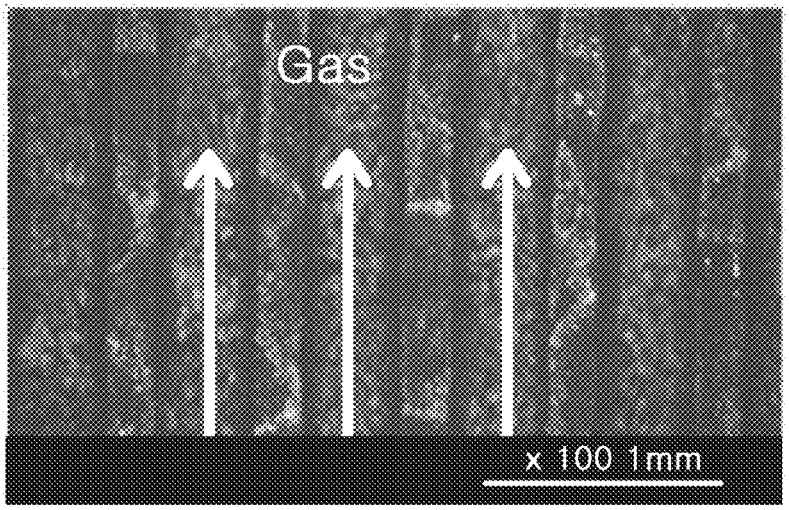
FIG. 2A Prior Art
FIG. 2A is an image of a surface-treated casting roll of a twin-roll strip caster of the related art.
Figure 2B:
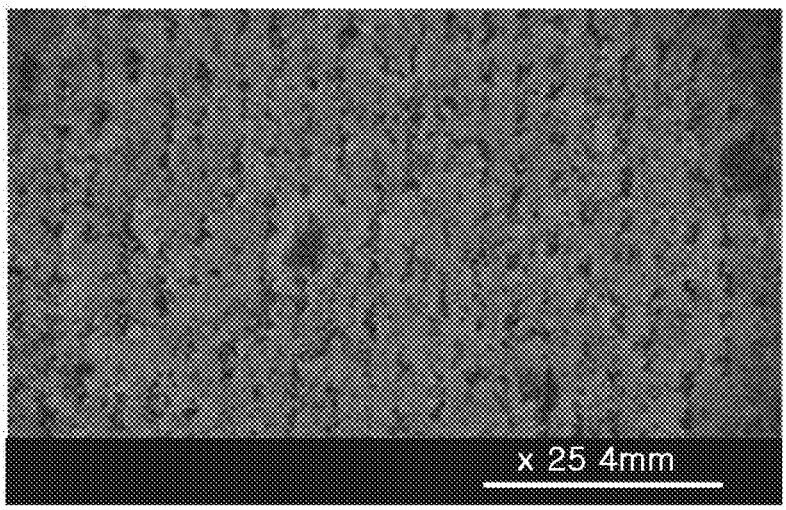
FIG. 2B Prior Art
FIG. 2B is an image of a surface of a strip formed through a casting process using a casting roll surface-treated as illustrated in FIG. 2A.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements. Moreover, detailed descriptions related to well-known functions or configurations will be ruled out in order not to unnecessarily obscure subject matters of the exemplary embodiments of the present disclosure.

An aspect of the present disclosure relates to a casting roll of a twin-roll strip caster for forming a strip through a casting process while preventing the formation of surface dimples.

According to the aspect of the present disclosure, the casting roll of the twin-roll strip caster includes a plurality of diagonal fine grooves formed in a surface thereof, the fine grooves symmetrically intersecting each other at an angle of 30° to 70° with respect to a circumferential direction of the casting roll.

Before the fine grooves are formed in the surface of the casting roll, dimples may be formed in the surface of the casting roll within an average roughness Ra ranging from 10 μm to 30 μm. If the average roughness Ra of the casting roll is less than 10 μm, the casting roll may not securely hold a solidified shell when molten steel solidifies and contracts, and thus, surface cracks may be formed. On the other hand, if the average roughness Ra of the casting roll is greater than 30 μm, although surface cracks are prevented, a final cold-rolled product may have a high degree of surface roughness and thus poor surface quality. The dimples may be randomly formed. The dimples may be formed by a shot blasting method that is economical in terms of processing costs.

In addition, since the amount of supersaturated nitrogen gas escaping from molten steel during solidification of the molten steel is varied according to the nitrogen content of the molten steel, the width and depth the fine grooves may be increased if molten steel having a high nitrogen content is used and may be decreased if molten steel having a low nitrogen content is used. That is, the width, interval, and depth of the fine grooves may be selectively determined to allow saturated nitrogen gas to be easily discharged during solidification of molten steel and thus to prevent the separation phenomenon of solidified shells and surface dimples of a product after a forming process.

Preferably, the fine grooves may have a width of 50 μm to 500 μm. The width or depth of the fine grooves is set to be 50 μm or greater. Otherwise, the fine grooves may not function as gas discharge passages because the fine grooves may be too small as compared to the depth of dimples formed by shot blasting before the formation of the fine grooves.

In addition, preferably, the fine grooves may have a depth of 50 μm to 200 μm. If the width or depth of the fine grooves is greater than 500 μm or 200 μm, molten steel may excessively flow into the fine grooves and stick to the casting roll.

In addition, preferably, the fine grooves may be formed at intervals of 100 μm to 1000 μm. The interval of the fine grooves is set to be within the range of 100 μm to 1000 μm due to the following reasons. If the interval of the fine grooves is less than 100 μm, the contact area between the casting roll and molten steel may be too small to maintain the static pressure of the molten steel and allow for sufficient heat transfer, and thus a product having surface defects may be produced. On the other hand, if the interval of the fine grooves is greater than 1000 μm, gas may not be sufficiently discharged.

The fine grooves are diagonally formed in the surface of the casting roll and symmetrically intersect each other at an angle of 30° to 70° with respect to the circumferential direction of the casting roll, so that when molten steel is cast into a strip by using the casting roll, the molten steel may first make contact with ridges protruding from the surface of the casting roll and may start to solidify at the ridges. That is, since fine ridges are formed along the whole width of the casting roll, the positions of solidification nuclei may be uniform along the whole width of the casting roll, and gas not dissolved in the molten steel due to a high nitrogen content of the molten steel may be discharged along valleys toward an upper surface of the molten steel, thereby inducing uniform solidification and producing a strip without a surface pattern parallel to the circumference of the casting roll.

In a casting process using the casting roll, the thickness of a solidified shell may be 1.5 mm or more. When a high-nitrogen duplex stainless steel strip is manufactured through a casting process using a twin-roll strip caster, solidified shells are separated due to the discharge of nitrogen gas during solidification. In this case, if the thickness of the solidified shells is less than 1.5 mm, the high-temperature strength of the solidified shells may be insufficient, and thus surface defects may be formed. Therefore, the thickness of solidified shells may be controlled to be 1.5 mm or greater so as to manufacture a strip without surface defects.

Figure 4A:
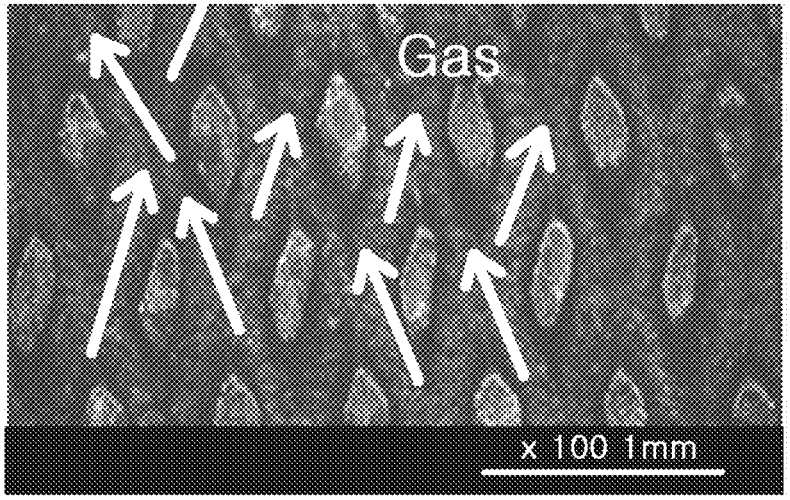
FIG. 4A is an image illustrating a surface of a casting roll of a twin-roll strip caster according to an exemplary embodiment of an aspect of the present disclosure.
Figure 4B:
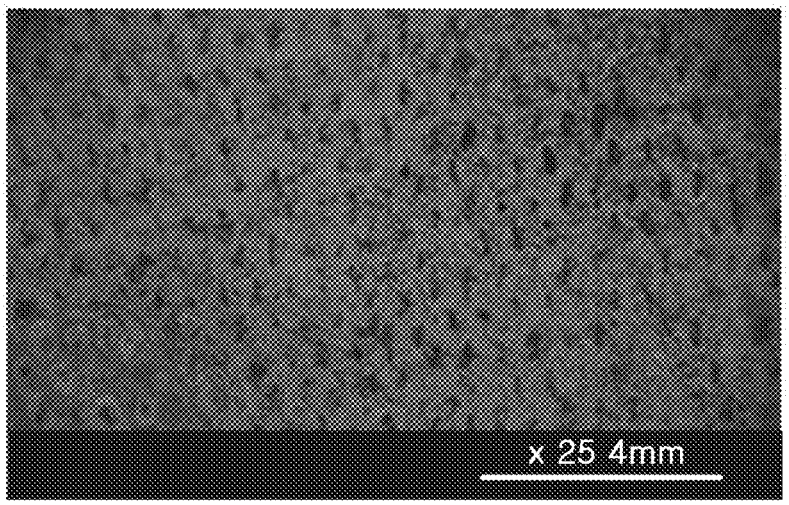
FIG. 4B is an image illustrating a surface of a strip manufactured through a casting process using a casting roll surface-treated like the casting roll illustrated in FIG. 4A according to the exemplary embodiment of the aspect of the present disclosure.

According to an exemplary embodiment of the aspect of the present disclosure illustrated in FIG. 4A, fine grooves are diagonally formed to provide various passages for the discharge of nitrogen gas during solidification. Thus, owing to an improved gas discharge ability, a strip having a random surface shape may be manufactured as illustrated in FIG. 4B. In addition, since protrusions formed on the surface of the casting roll function as solidification initiation points and improve solidification, problems related to the directivity of patterns formed on a strip in parallel to the circumference of the casting roll may be fundamentally removed.

Figure 3A:
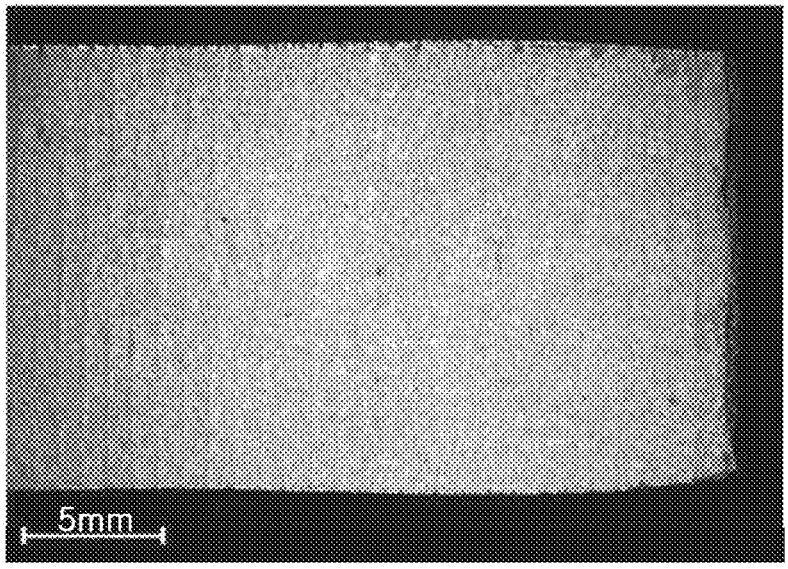
FIG. 3A Prior Art
FIG. 3A is an image illustrating surface dimples of a strip when the strip undergoes a drawing process after a casting process using a casting roll surface-treated according to the related art as illustrated in FIG. 2A and a cold rolling process.
Figure 3B:
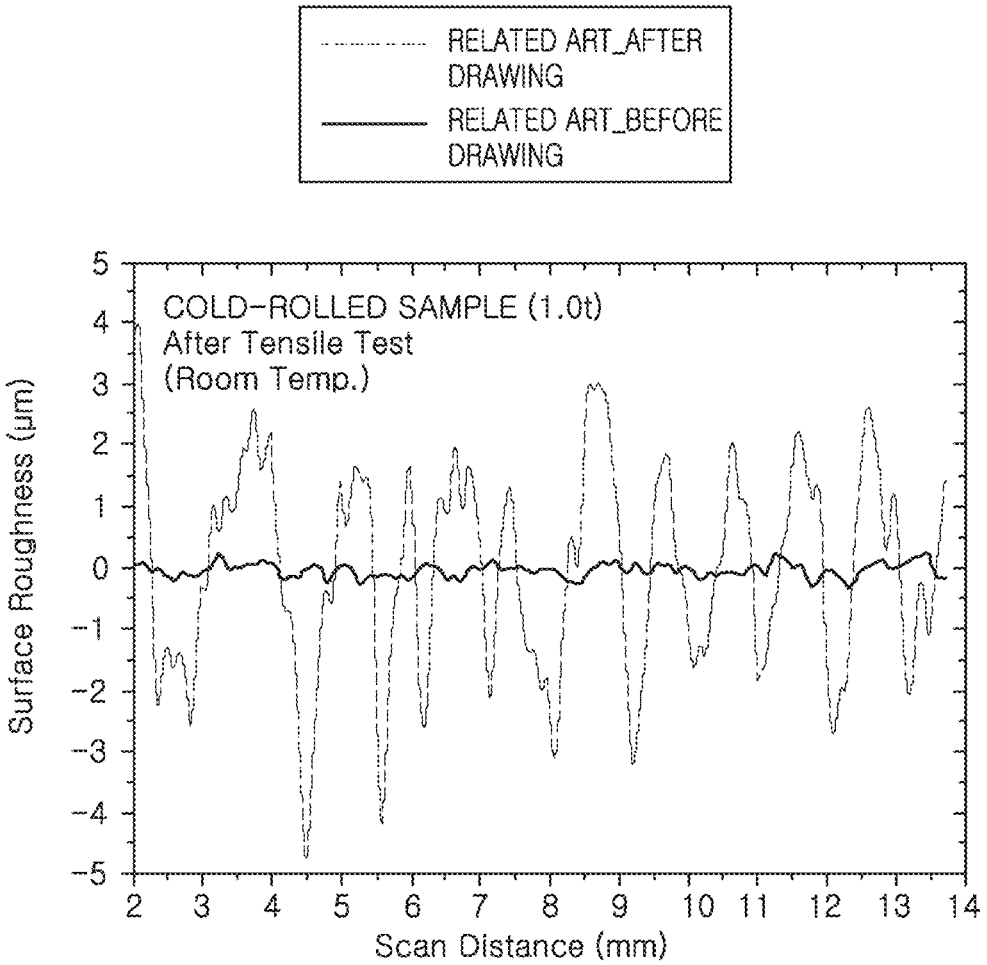
FIG. 3B Prior Art
FIG. 3B is a graph obtained by measuring the surface dimples of the strip illustrated in FIG. 3A after the drawing process.

FIG. 3A is an image illustrating surface dimples of a product when the product undergoes a drawing process after a casting process performed using a related-art casting roll on which fine grooves are formed in a striped pattern, and FIG. 3B is a graph illustrating the surface dimples of the product of FIG. 3A. Referring to FIG. 3B, a regular pattern is present in the roughness of the product. If the regular pattern is observable with the naked eye, the surface quality of the product is considered to be poor.

Figure 5A:
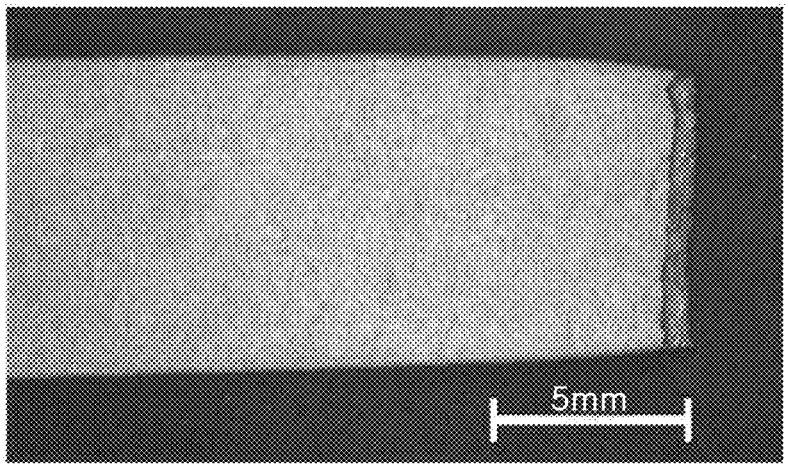
FIG. 5A is an image illustrating a surface of a strip manufactured through a casting process using a casting roll surface-treated like the casting roll illustrated in FIG. 4A and a drawing process according to the exemplary embodiment of the aspect of the present disclosure.
Figure 5B:
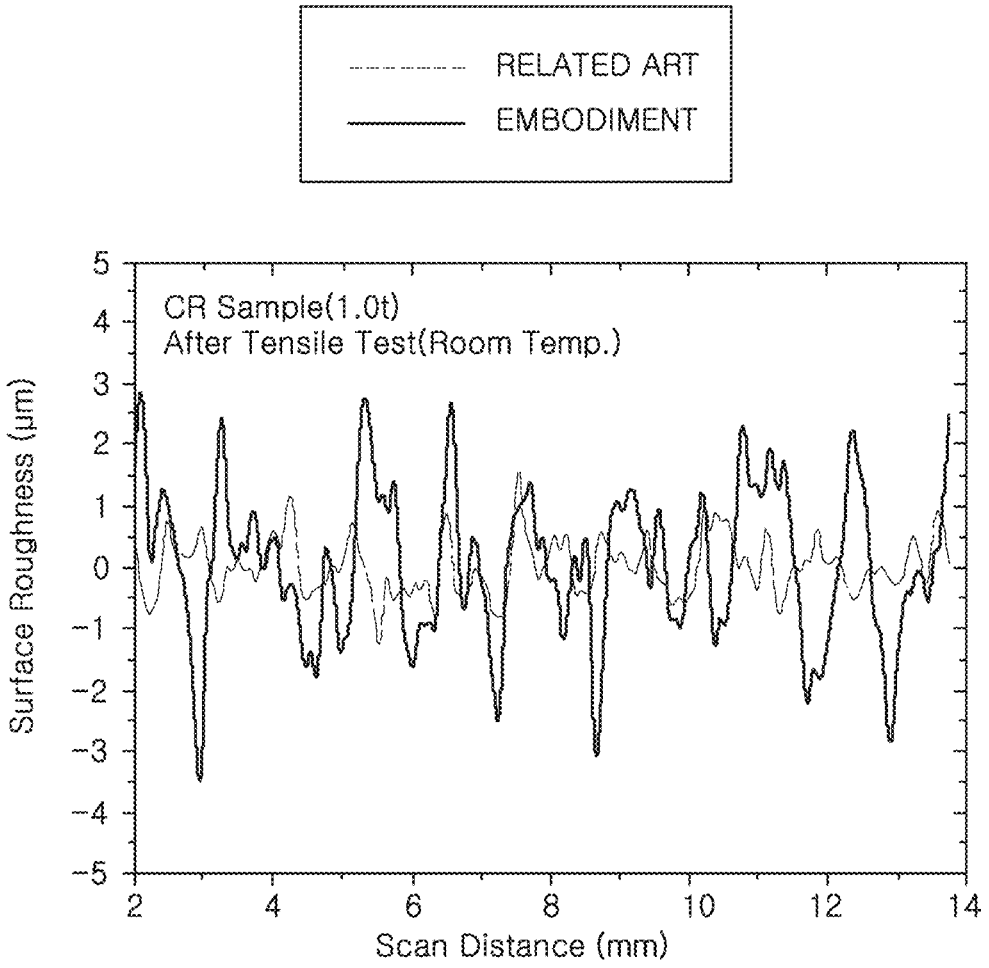
FIG. 5B is a graph illustrating the surface roughness of the strip of FIG. 5A measured after the drawing process according to the exemplary embodiment of the aspect of the present disclosure.
Figure 6A:
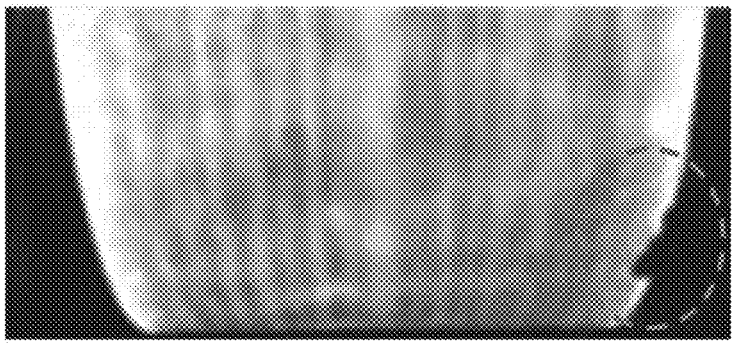
FIG. 6A Prior Art
FIGS. 6A and 6B are images illustrating exemplary strips whose widthwise edge portions have been separated due to a sticking phenomenon caused by skulls.
Figure 6B:
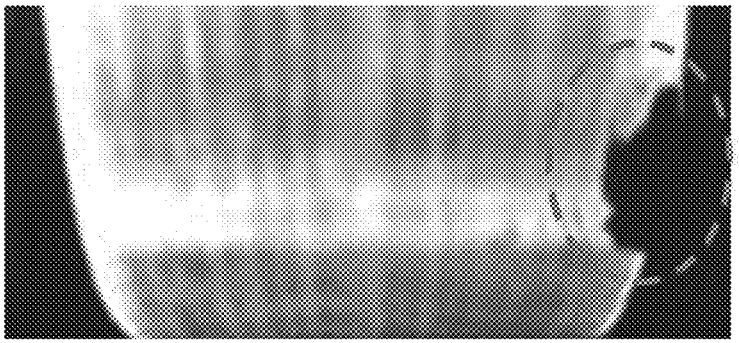
FIG. 6B Prior Art

On the other hand, FIG. 5A illustrates an aesthetically-pleasing surface of a product manufactured through a casting process using a casting roll on which diagonal fine grooves are formed according to the exemplary embodiment of the present disclosure and a drawing process. FIG. 5B is a graph illustrating the surface of the product of FIG. 5. When compared to FIG. 3B, a regular pattern is considerably reduced in the roughness of the product. Owing to this difference, as illustrated in FIG. 5A, surface dimples of the product are reduced so that it may be difficult to observe the surface dimples with the naked eye.

Hereinafter, a detailed description will be given of a method for manufacturing a casting roll of a twin-roll strip caster according to an aspect of the present disclosure.

According to the aspect of the present disclosure, the method for manufacturing a casting roll of a twin-roll strip caster may include: forming dimples in a surface of a casting roll of a twin-roll strip caster by a shot blasting method until the casting roll has a surface roughness of 10 μm to 30 μm; forming a polymer film on the casting roll; forming a diagonal pattern on the polymer film using a laser, the diagonal pattern having a line width of 50 μm to 500 μm and a line interval of 100 μm to 1000 μm, lines of the diagonal pattern symmetrically intersecting each other at an angle of 30° to 70° with respect to circumferential direction of the casting roll; and etching patterned portions of the casting roll from which the polymer layer is removed by the formation of the diagonal pattern using the laser, the etching being performed until the patterned portions of the casting roll are etched to a depth of 50 μm to 200 μm.

Before fine grooves are formed in the surface of the casting roll of the twin-roll strip caster, the dimples are formed in the surface of the casting roll until the casting roll has a surface roughness of 10 μm to 30 μm. Owing to this, the casting roll may securely hold a solidified shell during solidification and shrinkage. The dimples may be formed by a shot blasting method to randomly and economically form the dimples at low cost.

Thereafter, the polymer film may be formed on the casting roll by directly attaching the polymer film to the casting roll or applying a liquid polymer to the casting roll using a brush or a sprayer and drying the liquid polymer.

The polymer film may be formed of liquid photo resist (LPR). Although the dimples are already formed in the casting roll by shot blasting, LPR may be applied to the casting roll to a uniform thickness.

After the polymer film is cured, portions of the polymer film are removed using a laser to form a pattern. Since portions of the polymer film are removed using a laser instead of using a photo etching process including film attachment, exposure, and developing procedures, work in a darkroom or developing using a light source are not performed, and the removing of the portions of the polymer film may be performed regardless of the state of the dimples of the casting roll.

After the pattern is formed using the laser, portions of the casting roll from which the polymer film is removed may be dipped into or sprayed with an etchant until the portions of the casting roll are etched away to a depth of 50 μm to 200 μm. For example, the etchant may be a mixture of $FeCl_4$, HCl, and $H_2O$ or a mixture of $FeCl_3$, HCl, and $H_2O$.

Hereinafter, a casting roll of a twin-roll strip caster for stably performing a casting process while improving the quality of edges of a strip will be described in detail according to another aspect of the present disclosure.

A plurality of diagonal fine grooves are formed in a surface of the casting roll, and the fine grooves have a reverse triangular cross-sectional shape in widthwise edge portions of the casting roll.

Figure 7:
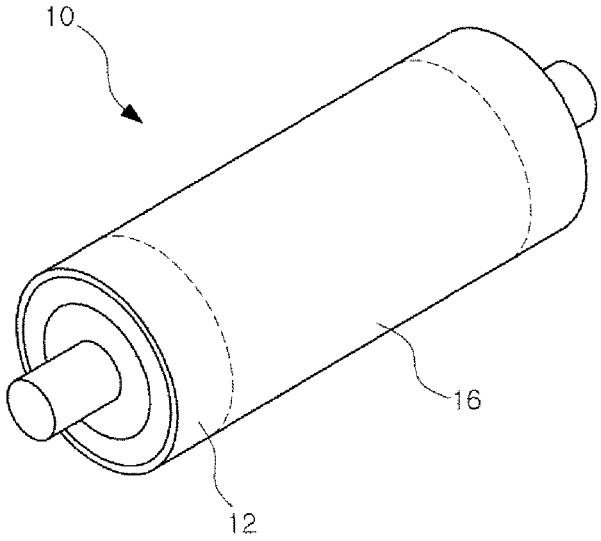
FIG. 7 is a perspective view illustrating a casting roll according to another aspect of the present disclosure.
Figure 8:
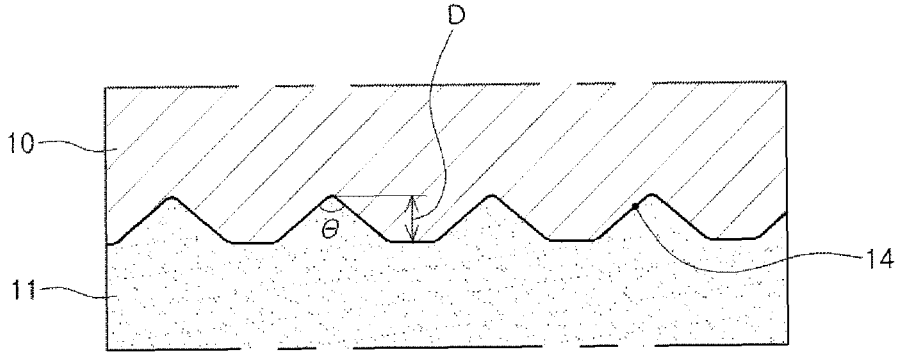
FIG. 8 is a cross-sectional view illustrating a casting roll according to an exemplary embodiment of the other aspect of the present disclosure.

FIG. 7 is an enlarged perspective view illustrating a casting roll 10 according to the other aspect of the present disclosure, and FIG. 8 is a cross-sectional view illustrating the casting roll 10 according to an exemplary embodiment of the other aspect of the present disclosure.

Referring to FIGS. 7 and 8, according to the exemplary embodiment of the other aspect of the present disclosure, the casting roll 10 of a twin-roll strip caster includes a plurality of fine grooves 14 formed in a surface thereof, and the fine grooves 14 have a reverse triangular cross-sectional shape in widthwise edge portions 12 of the casting roll 10. In FIG. 7, reference numeral 11 refers to a strip.

In the present disclosure, the edge portions 12 of the casting roll 10 refers to portions each defined from a widthwise end of the casting roll 10 to a position separated from the widthwise end by about 30 mm or less, and a portion of the casting roll 10 except for the edge portions 12 will now be referred to as a middle portion 16 for illustrative purposes.

For example, when a strip is formed of duplex stainless steel having a high nitrogen content of 2000 ppm or greater, high-manganese steel, or steel undergoing a high degree of phase transformation during solidification, surface defects such as dents, depressions, or cracks may formed in the strip if a large amount of generated gas is not smoothly discharged.

Therefore, in the exemplary embodiment of the other aspect of the present disclosure, the fine grooves 14 are formed to have a reverse triangular cross-sectional shape so as to prevent surface defects and easily separate a solidified shell even when the solidified shell is jammed in the fine grooves 14. In this case, some of edges of the fine grooves 14 may be rounded according to a method of forming the fine grooves 14. In this manner, a solidified shell may be prevented from sticking to the casting roll 10.

The reverse triangular cross-sectional shape of the fine grooves 14 in the widthwise edge portions 12 may have an included angle θ of about 30° to about 70° and a depth D of about 200 μm to about 300 μm. If the depth D of the fine grooves 14 is increased without varying the included angle of the fine grooves 14, the gas discharging ability of the fine grooves 14 may be improved. However, if the depth of the fine grooves 14 is increased to be greater than 300 μm without varying the pitch (interval) of the fine grooves 14, the width of ridges is reduced but the width of valleys is excessively increased. Therefore, molten steel may permeate into the fine grooves 14, and thus gas discharge passages may be narrowed to cause surface defects.

On the other hand, if the depth D of the fine grooves 14 is less than 200 μm, when the amount of gas to be discharged is large, the gas may not be smoothly discharged, and thus surface defects may be formed.

In an example, duplex stainless steel having the following composition illustrated in Table 1 was melted, and strips were formed by casting the molten steel.

TABLE 1

| Alloy composition | C | Si | Mn | P | S | Cr | Ni | Mo | N |
|---|---|---|---|---|---|---|---|---|---|
| Content (wt %) | 0.02 to 0.1 | 0.5 to 1.5 | 1 to 5 | 0.03 or less | 0.02 or less | 19 to 23 | 1 to 6.5 | 0.5 to 3.5 | 0.1 to 0.3 |

During the casting, the surface of the molten steel was sealed using the meniscus shield 7 illustrated in FIG. 1 for gas atmosphere control, and nitrogen gas was supplied above the surface of the molten steel to form a gas atmosphere at a pressure of about 200 mmAq (mm of water). At that time, casting rolls having edge portion conditions as illustrated in Table 2 were used. Table 2 also shows whether molten steel permeation, molten steel sticking, and depressions have occurred.

TABLE 2

| Included angle of fine grooves (°) | Depth of fine grooves (μm) | Pitch of fine grooves (μm) | Width of fine grooves (μm) | Gas discharge ability (G) | Molten steel permeation | Depressions | Sticking | Effects |
|---|---|---|---|---|---|---|---|---|
| 90 | 150 | 700 | 383 | 49 | N | Y | N | Poor |
| | 200 | 700 | 483 | 80 | Y | Y | N | Poor |
| | 250 | 700 | 583 | 118 | Y | Y | N | Poor |
| | 300 | 700 | 683 | 168 | Y | Y | N | Poor |
| 70 | 150 | 700 | 314 | 44 | N | Y | N | Poor |
| | 200 | 700 | 384 | 69 | N | N | N | Good |
| | 250 | 700 | 454 | 99 | N | N | N | Good |
| 60 | 150 | 700 | 289 | 42 | N | Y | N | Poor |
| | 200 | 700 | 346 | 64 | N | N | N | Good |
| | 250 | 700 | 404 | 91 | N | N | N | Good |
| | 300 | 700 | 462 | 122 | N | N | N | Good |
| 30 | 150 | 700 | 234 | 38 | N | Y | N | Poor |
| | 250 | 700 | 287 | 76 | N | N | N | Good |
| | 300 | 700 | 314 | 97 | N | N | N | Good |

In Table 2, the gas discharge ability G is A/P (G=A/P) where A refers to the sectional area of each of fine grooves, and P refers to the pitch of the fine grooves.

As illustrated in Table 2, when the gas discharge ability G was 60 or greater, surface defects might not be formed. In the exemplary embodiment of the other aspect of the present disclosure, the size of the fine grooves 14 at the edge portions 12 of the casting roll 10 may be determined while controlling the included angle of the fine grooves 14 within the range of 30° to 70°.

Figure 11:
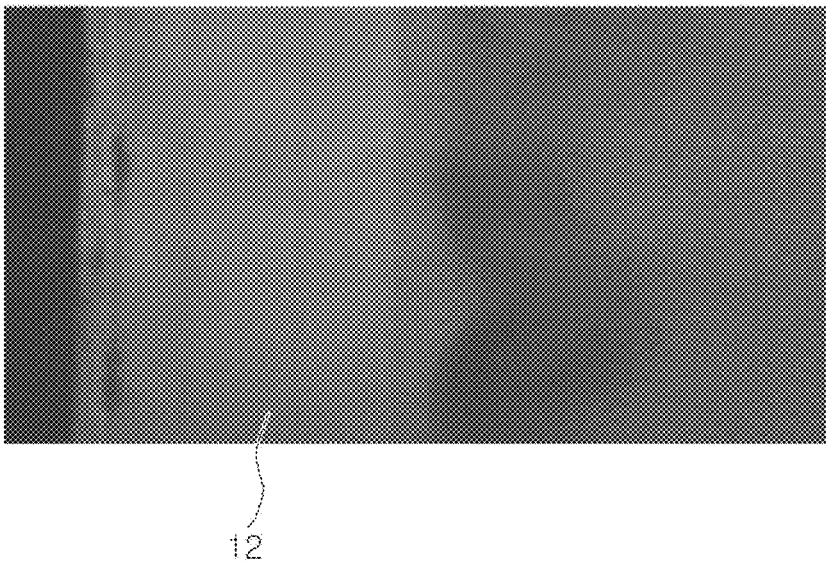
FIG. 11 is an image illustrating widthwise edge portions of a strip manufactured using a casting roll according to the other aspect of the present disclosure.

FIG. 11 is an image illustrating widthwise edge portions of a strip manufactured using the casting roll of the other aspect of the present disclosure. The casting roll used to manufacture the strip illustrated in FIG. 11 has edge portion conditions illustrated in Table 2: included angle=60°, depth=250 μm, width=404 μm, and G=91. As described above, if the casting roll of the exemplary embodiment of the other aspect of the present disclosure is used, a strip without surface defects on edge portions thereof may be manufactured. That is, products having improved quality may be manufactured with improved process yield.

Particularly, when the casting roll of the exemplary embodiment of the other aspect of the present disclosure was used, the rate of casting process interruptions due to separation and remixing of portions of a strip caused by a sticking phenomenon was markedly reduced from 65% to 5%, and thus casting stability was improved.

In the exemplary embodiment of the other aspect of the present disclosure, the fine grooves 14 may be formed in the edge portions 12 of the casting roll 10 by any method known in the related art without limitations. For example, the fine grooves 14 may be formed in the edge portions 12 of the casting roll 10 by using a precision machine tool such as a lathe. In addition, the fine grooves 14 may also be formed in the other portion of the casting roll 10 using such a machine tool.

Alternatively, the fine grooves 14 may be formed by casting high-energy laser rays on the casting roll 10 and chemically etching the casting roll 10.

Figure 9:
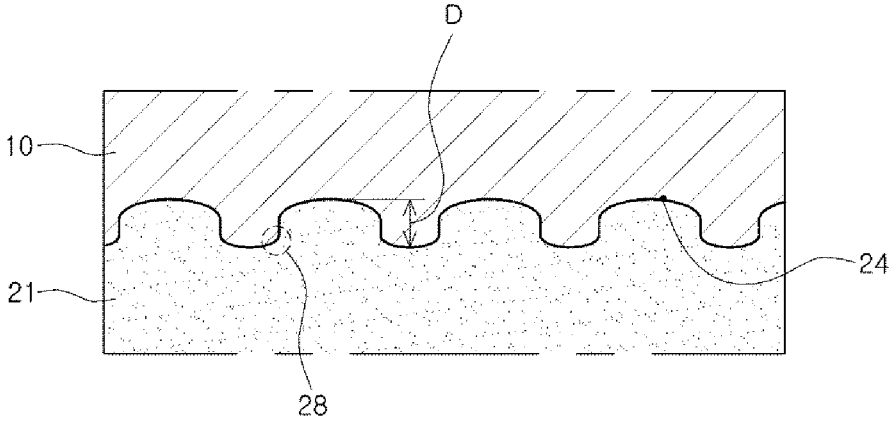
FIG. 9 is a cross-sectional view illustrating a casting roll according to another exemplary embodiment of the other aspect of the present disclosure.
Figure 10:
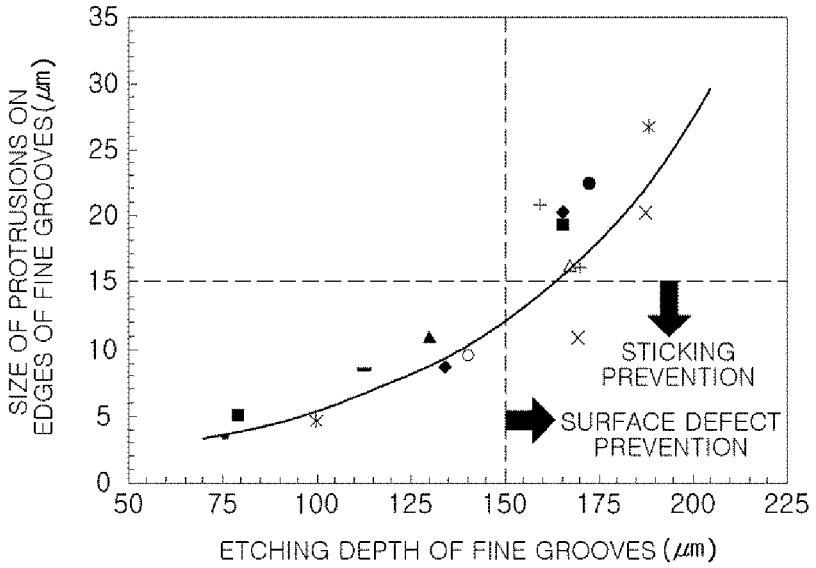
FIG. 10 is a graph illustrating a relationship between etching depth and protrusions formed on edges of fine grooves when the fine grooves are formed by etching.

FIG. 9 is a cross-sectional view illustrating a casting roll 10 according to another exemplary embodiment of the other aspect of the present disclosure, and FIG. 10 is a graph illustrating a relationship between etching depth and protrusions formed on edges of fine grooves when the fine grooves are formed by etching.

Referring to FIGS. 9 and 10, according to the other exemplary embodiment of the other aspect of the present disclosure, the casting roll 10 for a twin-roll strip caster includes a plurality of fine grooves 24 formed in a surface thereof. The fine grooves 24 may be formed through an etching process in a portion of the casting roll 10 except for widthwise edge portions 12 of the casting roll 10, that is, in a middle portion 16 of the casting roll 10, and the depth D of the fine grooves 24 may be greater than 0 μm but equal to or less than 175 μm in regions defined within a range of 30 mm to 50 mm from widthwise ends of the casting roll 10. In FIG. 9, reference numeral 21 refers to a strip.

In the other exemplary embodiment of the other aspect of the present disclosure, the casting roll 10 may be processed using an etching method. In this case, due the characteristics of the etching method, the fine grooves 24 may have a pot-shaped cross section as illustrated in FIG. 9.

In addition, a solidified shell may be caught in the casting roll 10 according to the shape of the fine grooves 24 varying in relation to the depth of etching. More specifically, if the depth of etching increases, larger protrusions are formed on edges of the fine grooves 24, and thus a solidified shell may be more easily caught in the casting roll 10 and may not be easily separated from the casting roll 10. In this case, edge portions of a strip may be separated from the strip.

Therefore, in the other exemplary embodiment of the other aspect of the present disclosure, it may be preferable that the size of protrusions 28 formed on edges of the fine grooves 24 be adjusted within the range of greater than 0 μm to 15 μm. The depth D of the fine grooves 24 may be restricted to adjust the size of the protrusions 28 formed on the edges of the fine grooves 24. For example, based on the curve of FIG. 10, the depth D of the fine grooves 24 is restricted to be greater than 0 μm but equal to or less than 175 μm.

As described above, if the depth D of the fine grooves 24 in the edge portions 12 of the casting roll 10 and the size of the protrusions 28 on the edges of the fine grooves 24 are restricted, even in the case that a solidified shell is caught in the fine grooves 24 of the casting roll 10 when a strip is manufactured using the twin-roll strip caster, the solidified shell may not be firmly held in the fine grooves 24, and thus the solidified shell may be easily separated from the fine grooves 24. Therefore, strips having high quality, particularly, without surface defects, may be manufactured with high yield.

As set forth above, according to exemplary embodiments of the present disclosure, if the casting roll for a twin-roll strip caster is used to manufacture a strip from high-nitrogen duplex stainless steel, high-manganese steel, or steel undergoing a high degree of phase transformation during solidification, dimples may not be formed in the surface of the strip, and the strip may not have a periodic dimple pattern after a forming process.

In addition, when a strip is formed using the casting roll for a twin-roll strip caster, since the fine grooves having a reverse triangular cross-sectional shape are formed in the widthwise edge portions of the casting roll, even in the case that a solidified shell is caught in the casting roll, the solidified shell may be easily separated, and thus the strip may not have surface defects. That is, high-quality strips may be manufactured with improved yield while preventing separation of edge portions from the strips and decreasing the rate of casting process interruptions, thereby improving the stability of casting processes.

While exemplary embodiments have been shown and described above, it will be apparent to those skilled in the art that modifications and variations could be made without departing from the scope of the present invention as defined by the appended claims.

For example, the configuration in which fine grooves having a depth within the range of greater than 0 μm to 175 μm as described in the other exemplary embodiment of the other aspect of the present disclosure may be formed in edge portions of a casting roll instead of the configuration in which fine grooves have a reverse triangular cross-sectional shape. In this case, fine grooves having a depth of greater than 0 μm to 300 μm may be formed in a middle portion of the casting roll.

The exemplary embodiments of the present disclosure are for illustrative purposes only and are not intended to limit the scope of the present invention. Therefore, it should be understood that modifications, equivalents, and replacements could be made from the exemplary embodiments within the scope of the present invention as defined by the appended claims.

What is claimed is:

1. A casting roll for a twin-roll strip caster, the casting roll comprising a plurality of diagonal fine grooves formed in a surface thereof, the fine grooves symmetrically intersecting each other, wherein first fine grooves of the fine grooves have a reverse triangular cross-sectional shape in widthwise edge portions of the casting roll, and the first fine grooves have a depth of 200 μm to 300 μm in the widthwise edge portions, wherein the reverse triangular cross-sectional shape of the first fine grooves in the widthwise edge portions of the casting roll has an included angle of 30° to 70°, and wherein second fine grooves of the fine grooves are formed by etching in a remaining portion of the casting roll.

2. The casting roll of claim 1, wherein the first and second fine grooves have a width of 50 μm to 500 μm.

3. The casting roll of claim 1, wherein the fine grooves are formed at intervals of 100 μm to 1000 μm.

4. The casting roll of claim 1, wherein a depth of the second fine grooves is greater than 0 μm and equal to or less than 175 μm.

5. The casting roll of claim 1, wherein before the fine grooves are formed in the surface of the casting roll, dimples are formed in the surface of the casting roll within an average roughness Ra ranging from 10 μm to 30 μm.

6. The casting roll of claim 5, wherein the dimples are formed by shot blasting.

7. The casting roll of claim 1, wherein each of the widthwise edge portions is defined from a widthwise end of the casting roll to a position separated from the widthwise end by 30 mm or less.

8. The casting roll of claim 1, wherein the first fine grooves in the widthwise edge portions have a gas discharge ability of 60 calculated by G=A/P where G refers to the gas discharge ability, A refers to a cross-sectional area of each of the fine grooves measured in square micrometers ($\mu m^2$), and P refers to a pitch of the fine grooves measured in micrometers ($\mu m$).

9. The casting roll of claim 1, wherein the first fine grooves are formed by machining in the widthwise edge portions of the casting roll.

* * * * *